United States Patent [19]

Watanabe

[11] Patent Number: 4,751,771

[45] Date of Patent: Jun. 21, 1988

[54] BUTTON

[75] Inventor: Hirokazu Watanabe, Kurobe, Japan

[73] Assignee: Yoshida Kogyo K. K., Tokyo, Japan

[21] Appl. No.: 24,661

[22] Filed: Mar. 11, 1987

[30] Foreign Application Priority Data

Mar. 13, 1986 [JP] Japan ..... 61-35385[U]

[51] Int. Cl.[4] ..... A44B 1/42

[52] U.S. Cl. ..... 24/95; 24/90 A; 24/90 E

[58] Field of Search ..... 24/90 R, 90 C, 90 E, 24/90 A, 94, 93, 95, 101 B, 113 MP

[56] References Cited

U.S. PATENT DOCUMENTS

| | | | |
|---|---|---|---|
| 1,366,388 | 1/1921 | Keller | 24/90 E |
| 2,067,223 | 1/1937 | Janes | 24/95 |
| 2,261,285 | 11/1941 | Purinton | 24/90 E |
| 2,267,667 | 12/1941 | Purinton | 24/90 E |
| 2,635,316 | 4/1953 | Reiter . | |
| 4,512,063 | 4/1985 | Fukuroi | 24/95 |
| 4,571,781 | 2/1986 | Kanzaka et al. | 24/95 |
| 4,607,415 | 8/1986 | Fukuroi | 24/95 |
| 4,672,718 | 6/1987 | Schlueter et al. | 24/90 A |

FOREIGN PATENT DOCUMENTS

| | | | |
|---|---|---|---|
| 59-25208 | 2/1984 | Japan . | |
| 583255 | 12/1946 | United Kingdom . | |
| 698187 | 10/1953 | United Kingdom | 24/90 A |
| 740235 | 11/1955 | United Kingdom . | |

*Primary Examiner*—Victor N. Sakran

*Attorney, Agent, or Firm*—Hill, Van Santen, Steadman & Simpson

[57] ABSTRACT

A button includes a button body and a tack member for attachment of the button to a garment fabric. The button body includes an annular brace holding a button back and a head plate peripherally together. The head plate is made of a die-cast zinc having its front surface exposed to view. The annular brace and the buton back are made of a metal plate having a high ductility conducive to prolonged service life.

8 Claims, 3 Drawing Sheets

BUTTON

BACKGROUND OF THE INVENTION

1. Field of the Invention

The present invention relates to a metal button including a button body and a tack member engageable therewith for attaching the button to a garment fabric, and more particularly a button body including a coverless head plate.

2. Prior Art

A known metal button used for jeans, for example, usually bears indicia on its head surface, i.e. its head cover. The head cover is often made of a die-cast metal, because it presents more conspicuous and clear view of the indicia.

Japanese Utility Model Laid-Open Publication No. 59-25208 discloses a metal button of this type as illustrated in FIG. 5 of the accompanying drawings. The disclosed button comprises a button body A′ and a tack member B′ for attaching the button to a garment fabric F. The button body A′ includes a cap 60, a button back 70 and an anvil plate 80 disposed therebetween. The cap 60 is made of a die-cast metal such as zinc and the button back is made of a brass or steel plate. The cap 60 has a marginal wall 61 peripherally bent downwardly over an annular flange 71 of the button back 70. The disclosed button has a drawback in its mechanical strength. The cap 60 of the die-cast metal tends to have a crack or other damage on its bent portion 62 when it undergoes external forces in a daily use of the button, because the bent portion 62 has residual stresses created by bending the marginal wall 61 during the assembling of the button body A′. The bent portion 62 is therefore susceptible to rupture and split open to reveal a sharp edge of the flange 71, or makes the cover 60 sometimes become separated from the button back 70.

SUMMARY OF THE INVENTION

According to the present invention, a metal button comprises a button body and a tack member for attaching the button to a garment fabric. The button body includes a button back, a molded head plate and an annular brace for holding the button body and the head plate together. The brace extends peripherally of both an annular flange of the button back and the head plate on the flange so as to expose the latter to view. The brace is cross-sectionally curved substantially along the peripheral contours of each of the flange and the head plate.

It is therefore an object of the present invention to provide a metal button for a garment fabric which is provided with increased structual strength and hence prolonged service life.

Another object of the present invention is to provide a metal button including a molded head plate which is exposed to constant view.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
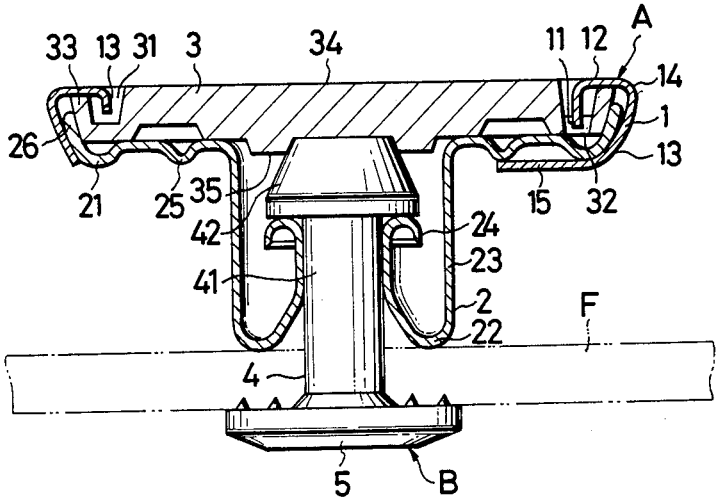
FIG. 1 is a vertical cross-sectional view of a button embodying the present invention, showing a tack member thereof in side elevation.
Figure 2:
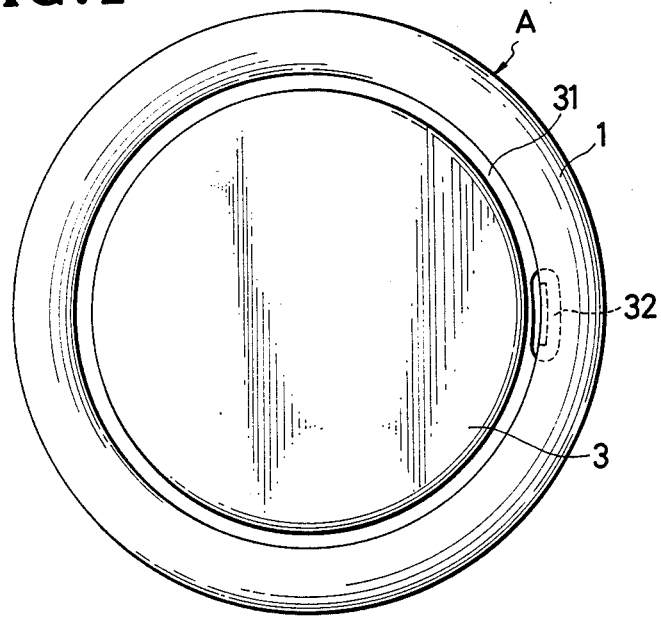
FIG. 2 is a plan view of the button.

As shown in FIGS. 1 and 2, a button includes a button body A and a tack member B adapted to join with the button body for attaching the button to a garment fabric F. The button body A includes a button back 2, a circular head plate 3 and an annular brace 1 for holding the button back 2 and the head plate together. The tack member has a head 5 and a shank 4 projecting centrally and perpendicularly from the head 5.

The button back 2 is made of a brass or steel plate. The button back 2 has an annular flange 21 formed with an annular wavy portion 25 having concentric recesses and lands, and a hollow hub formed with a double tube projecting concentrally downwardly from an inner edge of the wavy portion 25. The double tube has a pair of concentric inner and outer tubes joined at their lower ends by an annular turn 22. The inner tube has at its upper end an outwardly curved annular flange 24. The annular wavy portion 25 of the annular flange 21 extends substantially radially outwardly and terminates in an annular raised wall or rim 26.

The head plate 3 is molded of a proper material such as zinc or steel and has a thickness substantially greater than those of the button back 2 and the annular brace 1. The relatively thick head plate 3 has an annular groove 31 extending on an upper or front surface 34 of the plate 3 along its periphery, and an annular land portion 33 disposed outwardly adjacent to the groove. The head plate 3 has non-illustrated indicia such as an ornamental design which is formed on the upper surface during the molding of the head plate. A slot 32 is formed in a bottom of the groove 31 at one angular position thereof (FIG. 2) for a purpose described below. The head plate 3 of such construction is positioned on the annular flange 21 of the button back 2 so that the head plate 3 is peripherally engaged by the raised wall 26 of the flange. The head plate 3 may be made of an injection molded plastic resin.

The annular brace 1 is made of a brass or steel plate and extends surrounding peripheries of the head plate 3 and the button back 2. As better shown in the vertical cross section of FIG. 1, the brace 1 has upper and lower portions 12, 13 joined integrally to each other at a bent portion 14. The lower portion 13 extends downwardly from the bent portion 14 on and along an outer surface of the raised wall 26 of the button back 2 and reaches to a position under a lower part of the raised wall 26. The upper portion 12 extends horizontally and inwardly of the head plate beyond the annular land portion 33 thereof and terminats in the annular groove 31 to define edge a downwardly directed annular 13. The annular brace 1 also has a narrow extended portion 11 projecting downwardly from the downwardly directed edge 13 into the slot 32, and a tab 15 extending horizontally and inwardly of the button back from a lower edge of the lower portion 13 of the brace. The tab is disposed in registry with the narrow extended portion 11. The narrow extended portion 11 is loosely fit in the slot 32 and serves for preventing the head plate 3 from rotating with respect to the button back 2. In this particular enbodiment, an upper surface of the annular brace, i.e. of the upper portion 12 is flush with the upper face of the head plate 3.

For attachment of the button to the garment fabric F, the shank 4 of the tack member B is forced to penetrate the fabric F to be inserted into the inner tube of the hollow hub 23 of the button body A. When the shank 4 is fully inserted into the hollow hub 23, the distal end of the shank is pressed against a lower or reverse surface 35 of the head plate 3, thereby causing the distal end to be deformed into a radially outwardly bulged portion 42 in a well known manner. The head plate therefore serves also as a conventional anvil plate. The bulged portion 42 and a shank stock 41 are tightly engaged by the flange 24 and the inner tube wall, respectively, thereby preventing a separation of the tack member B from the button body A.

With the foregoing arangement, the annular brace 1 holds together the button back 2 and the head plate 3 in a reliable manner. Since the brace 1 is made of the brass or steel plate which has high ductility, the bent portion 14 of the brace is less likely to have mechanical damages such as a crack or breakage when it undergoes external undue forces imposed thereon in a daily use thereof. The head plate can expose to view its front surface 34 bearing characters or the like thereon. Clear indicia can be formed on the front surface 34 because the head plate 3 is thick enough to allow for formation of a relief thereon. In case the indicia which the head plate bears needs to be kept in a specified direction, the head plate can be deliberately retained in the desired direction by a retaining mechanism composed of the narrow extended portion and the slot receiving the same.

Figure 3:
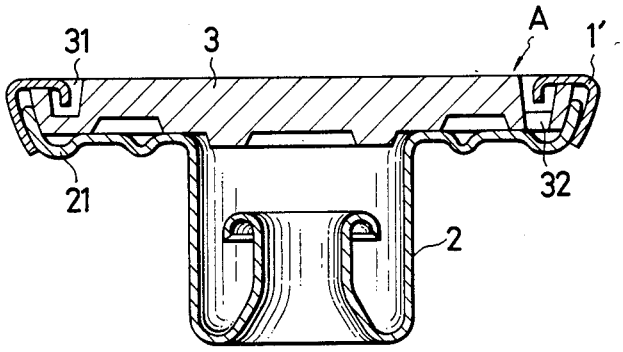
FIG. 3 is a vertical cross-sectional view of a part modification of the button.

FIG. 3 shows a modified annular brace 1' which is similar to the brace 1 of FIG. 1 except that the brace 1' has no counterparts corresponding to the narrow extended portion 11 and the tab 15.

Figure 4:
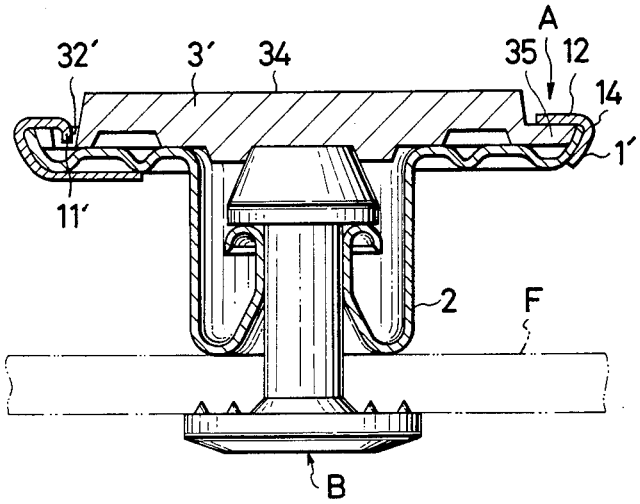
FIG. 4 is a vertical cross-sectional view similar to FIG. 1, showing a modified button body with the tack member joined therewith.
Figure 5:
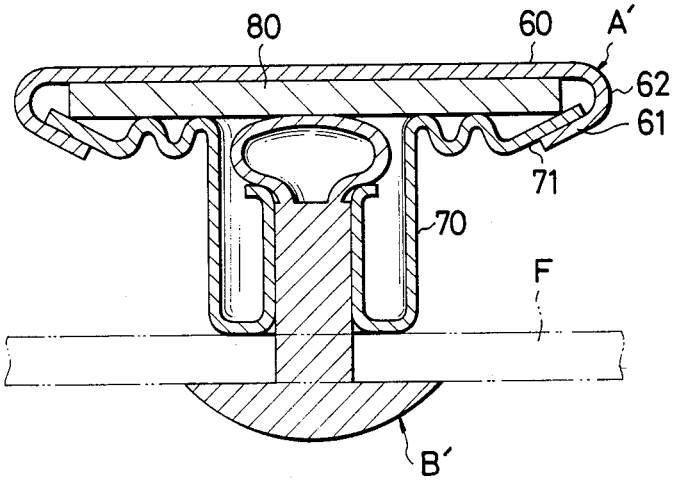
FIG. 5 PRIOR ART
FIG. 5 is a vertical cross-sectional view of a prior button.

FIG. 4 shows a modified button body A' which is similar to the button body A of FIG. 1. The modified button body A' includes a head plate 3' having an annular stepped portion 35 of a reduced thickness at its peripheral margin. The upper portion 12 of the brace 1' extends radially inwardly from its bent portion 14 on and along a horizontal surface of the stepped portion 35 and terminates in short of a substantially vertical surface of the same. A slot 32' is formed at one angular portion of the annular stepped portion for receiving a downwardly extended narrow portion 11' projecting from an inner edge of the brace 1'. In this embodiment, an upper surface of the brace 1' is disposed at a level lower than that of the obverse face 34 of the head plate 3. This arrangement is advantageous in keeping the brace, particularly the upper portion thereof from being trapped by an edge of the button hole of the garment when the button is unhooked.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A button for attachment to a garment fabric, comprising:

(a) a button body including a button back having a hollow hub projecting centrally therefrom, and an annular flange extending radially outwardly from an upprmost end of said hollow hub and terminating in a raised peripheral wall, (b) a tack member having a head and a shank projecting centrally integrally from said head for being pierced through the garment fabric to be inserted into said hollow hub of said button back for thereby attaching said button body to the garment fabric; and (c) said button body further including a head plate, and an annular brace made of a metal plate, said head plate being disposed on said annular flange and intimately engaged at its peripheral edge by said raised peripheral wall of the button back, said annular brace overlapping both an outer surface of said raised wall and a peripheral margin of said head plate throughout their peripheries for thereby holding said head plate and said button back together, said head plate having a front surface exposed, said head plate having an annular groove extending on the front surface thereof inwardly adjacent to the peripheral edge of said head plate, said annular brace having a downwardly directed annular edge disposed in said annular groove.

2. A button according to claim 1, said head plate having a slot at a bottom of said annular groove, said annular brace having a narrow extended portion projecting downwardly from said annular edge and received in said slot to thereby prevent relative rotation between said brace and said head.

3. A button for attachment to a garment fabric, comprising:

(a) a button body including a button back having a hollow hub projecting centrally therefrom, and an annular flange extending radially outwardly from an uppermost end of said hollow hub and terminating in a raised peripheral wall, (b) a tack member having a head and a shank projecting centrally integrally from said head for being pierced through the garment fabric to be inserted into said hollow hub of said button back for thereby attaching said button body to the garment fabric; and (c) said button body further including a head plate, an an annular brace made of a metal plate, said head plate being disposed on said annular flange and intimately engaged at its peripheral edge by said raised peripheral wall of the button back, said annular brace overlapping both an outer surface of said raised wall and a peripheral margin of said head plate throughout their peripheries for thereby holding said head plate and said button back together, said head plate having a front surface exposed, said head plate having at the peripheral margin an annular stepped portion, said annular brace having an upper horizontal portion extending on said stepped portion to thereby hold said head plate and said button back together, said upper horizontal portion of said brace being disposed at a recessed relative to the front surface of said head plate, said head plate having a slot in said stepped portion, said annular brace having a narrow extended portion projecting downwardly from an inner edge of said upper horizontal portion of said brace into said slot in said stepped portion.

4. A button for attachment to a garment fabric, comprising:

(a) a three-piece button body including a button back of a metal, a circular head plate, and an annular brace of a metal for holding said button back and said head plate together, said button back having a central hollow hub and an annular flange integrally extending radially outwardly from one end of said hollow hub and terminating in a raised peripheral wall, said head plate being disposed on said annular flange and intimately engaged at its peripheral edge by said raised peripheral wall of said annular flange;

(b) a tack member having a head and a shank integrally projecting centrally from said head for piercing through the garment fabric and for being inserted into said hollow hub of said button back to thereby attach said button body to the garment fabric; and (c) said annular brace being separate from both said head plate and said annular flange of said button back and overlapping both an outer surface of said raised wall and a peripheral margin of said head plate along their entire peripheries so as to have a front surface of said head plate centrally exposed.

5. A button according to claim 1, said head plate having at the peripheral margin an annular stepped portion, said annular brace having an upper horizontal portion extending on said stepped portion to thereby hold said head plate and said button back together, said upper horizontal portion of said brace being disposed at a level recessed relative to the front surface of said head plate.

6. A button according to claim 1, said head plate being made of a die-cast metal.

7. A button according to claim 4, said peripheral margin being stepped backwardly from the front surface of said head plate by substantially the thickness of said brace whereby the top surface of the brace and the front surface of the head plate lie in substantially the same plane.

8. A button according to claim 4, said annular brace consisting of a dictile material permanently deformed about the head plate and said raised wall without imposing cracking stresses in said brace.

* * * * *